United States Patent [19]

Ploussios

[11] 4,257,050

[45] Mar. 17, 1981

[54] LARGE ELEMENT ANTENNA ARRAY WITH GROUPED OVERLAPPED APERTURES

[76] Inventor: George Ploussios, 4 Hackney Cir., Andover, Mass. 01810

[21] Appl. No.: 878,331

[22] Filed: Feb. 16, 1978

[51] Int. Cl.[3] ..... H01Q 3/26

[52] U.S. Cl. ..... 343/854

[58] Field of Search ..... 343/754, 854, 777, 778

[56] References Cited

U.S. PATENT DOCUMENTS

| | | | |
|---|---|---|---|
| 3,295,134 | 12/1966 | Lowe | 343/854 |
| 3,474,447 | 10/1969 | Melancon | 343/854 |
| 3,729,742 | 4/1973 | Boyns | 343/854 |
| 3,852,761 | 12/1974 | Bogner | 343/854 |
| 3,964,066 | 6/1976 | Nemit | 343/854 |
| 4,041,501 | 8/1977 | Frazita | 343/854 |
| 4,124,852 | 11/1978 | Steudel | 343/854 |

*Primary Examiner*—Eli Lieberman

*Attorney, Agent, or Firm*—Robert T. Dunn

[57] ABSTRACT

An antenna for transmitting or receiving, for limited fine scan or wide angle scan, or for producing multiple beams has a plurality antenna radiators or receivers (apertures) in a linear array, coupled to a smaller plurality of antenna networks so that many of the antenna apertures are coupled to two of the networks and the networks are all coupled to a common transmission line. For a spatial scanning system, each network is coupled to the common transmission line through a variable phase shifter so that the radiation patterns of the apertures combine to define a beacon of predetermined fine pointing direction that can be used to spatially sweep a sector by varying the phase shifters according to a predetermined schedule. Furthermore, by shifting the point of feed to the networks, the pointing direction is caused to switch in relatively large steps, from one sector to another sector.

11 Claims, 15 Drawing Figures

ARRAY POINTING ERROR VS. PHASE ERROR

LARGE ELEMENT ANTENNA ARRAY WITH GROUPED OVERLAPPED APERTURES

BACKGROUND OF THE INVENTION

The present invention relates to antennas and more particularly to antennas having stationary antenna apertures or stationary radiators that are controlled so that the direction of the antenna radiation pattern is controlled.

The radiation pattern of an antenna system whether the system be a transmitting or receiving antenna is the net pattern of all radiating apertures of the antenna (if it is a transmitting antenna) or all radiation responsive apertures of the antenna (if it is a receiving antenna). The pointing direction of the net radiation pattern of an antenna system can be changed, of course, by physically moving or rotating the system. It can also be changed without any physical movement or rotation of parts of the antenna. Two well known, common types of antenna systems wherein the direction of the net radiation pattern of the system is changed without physical movement, are referred to generally as Phased Array Antenna Systems and the Optically Scanned Antenna Systems.

Phased Array Antenna System consists of a multitude of antenna apertures (radiating elements in a transmitting antenna) disposed in a fixed array and fed via a multitude of variable phase shifters that are controlled so that the phase of power to each element is controlled. As a result of the control, the net radiation pattern of all the elements is a beacon of predetermined shape whose pointing direction from one instant to the next is changed by changing the phase of power fed to the individual radiating elements.

An Optically Scanned Antenna System usually involves a single antenna aperture for which there is a focal point. In a transmitting antenna of this sort all radiation is considered as coming from the focal point. The pointing direction of the radiation pattern of the antenna is changed by changing the location of the focal point electrically. This has been accomplished using a single radiator that has many elements coupled together that are all fed the same frequency at different amplitude and phase so that the apparent point source of net radiation from the many elements moves depending on the balance of amplitudes and phases.

In both of the above described types of antenna systems, spatial beam scanning or sweeping is accomplished by scanning amplitude and/or phase of the RF power fed to the radiating elements. For small scan angles (small scan sectors covering several beam widths), accurate scanning or pointing of the beam with negligible degradation can be achieved by using relatively few variable phase shifters. For larger scan sectors, particularly over many beamwidths, many more variable components such as phase shifters and amplitude control devices are needed. Varying phase or power continually to cause the beam to scan a sector is sometimes referred to as phase or power scanning. It is one object of the present invention to provide an antenna system without mechanically moving elements, capable of producing a radiation pattern whose pointing direction can be changed electronically using fewer variable components, and particularly, fewer variable phase shifter than used in prior systems.

SUMMARY OF THE INVENTION

Various embodiments of the present invention described herein, representing the best known uses of the invention, are antenna systems for which the net radiation pattern has a pointing direction which can be caused to scan or switch directions by electronic controls. Fundamental features of the invention are incorporated in a Large Element Array (LEA) including a Spatial Scan Antenna System wherein the radiation pattern is capable of being spatially scanned over a plurality of sectors that covers as many as forty beamwidths of the main lobe of the pattern using no more than eight electronically controlled phase shifters and eight electronically controlled multi-position switches. The fundamental features are also applied in an LEA Multiple Beam Antenna System that is capable of switching among the plurality of beams produced.

In accordance with a fundamental feature of the present invention, a large linear array of $\eta$ antenna apertures are coupled as N sets of apertures to N antenna distributor networks. It is convenient, but not essential, that the sets all contain the same number of apertures. Let that number be $\alpha$, and so the total number of apertures is $\alpha \times N$. If the number of apertures in a set is greater than $\eta/N$, then, the sets must share apertures and so we can say the sets overlap. In other words the sets overlap, inasmuch as many apertures are common to more than one set and each set is coupled to a different one of the networks. All networks connect to a common transmission line each through a variable phase shifter or switch controlled network. When the array is used as a radiating antenna, the common line is energized with high frequency energy, (RF), and each antenna network generates a phase and amplitude distribution across its coupled radiators that results in a radiation pattern of pointing direction determined by the network The total array pattern is the combination of these network generated patterns. By varying the input phase of these networks, the combined pattern is spatially acanned over the beam generated from an individual network.

Another feature of the present invention has application to provide a radiation pattern whose pointing direction is stepped or switched from sector to sector as a coarse scan and then finely controlled to scan the sector. The overlapping antenna distribution networks from which the overlapping sets of antenna apertures (radiating elements) are electrically driven are each fed power via a multi-throw switch that feeds the power to one of several inputs of the network depending on the switch throw. Each input to the network results in a linear output phase of different slope corresponding to a radiated beam of different direction. In the Spatial Scan System, each network input switch is fed via a variable or controlled phase shifter and are all fed power from a common transmission line via a power divider. The resulting beacon pointing direction is stepped coarsely from one pointing direction to another (sector to sector) by actuation of the switch and over each sector, it is finely controlled by the phase shifters.

The fine scan over a sector is non-granular, whereas the coarse scan from sector to sector is granular. As described above, fine scan is caused by varying the phase shifters. For example, in a transmitting antenna, means are provided for varying the phase shifters in a conventional manner so that phase fed to a network (and so to the antenna apertures), one with respect to another, changes smoothly over a small range. The result of this is that the beam makes a fine non-granular sweep of the sector. This sector can be quite narrow, only a few beam widths wide. Thus, the above described fundamental feature of the present invention can be applied to provide a type of phased array antenna system wherein the relative phase of power in transmission lines is varied over a relatively small range before feeding to a far greater number of antenna apertures via switched points in antenna distribution networks and so provide a beam that sweeps smoothly over a relatively large range by coarse switching and then fine sweeping.

Stated broadly, there are in each antenna distribution network a plurality of electrical points which are at any given instant of time each at a different phase. A switch or other means is provided for coupling the network transmission line to one of these points at a time. For example, the network transmission line may couple to the distribution network via a single pole, multi-throw type of switch, referred to herein as SPMT switch. In operation, these switches are electronically controlled in a prescribed manner causing the beam to switch spatially from sector to sector as desired. A Spatial Scan System incorporating this feature does not require a great many precisely controlled variable phase shifters, nor does it require a variable power divider. The power divider may divide power from the common transmission line to the network transmission lines in a fixed manner that need not vary to achieve the special stepping and scanning.

It is an object of the present invention to provide an antenna system producing a directional net radiation pattern which direction is changed electronically wherein at least some of the disadvantages or limitations of prior antenna systems of this sort are avoided.

It is another object to provide an improved antenna system that produces a spatially scanning radiation pattern electronically.

It is an object of the present invention to provide an antenna system of an array of stationary antenna apertures that produces a spatially scanning beacon radiation pattern.

It is an object of the present invention to provide an antenna system of an array of antenna apertures, stationary with respect to each other, that produces a highly directional beacon radiation pattern whose pointing direction can be rapidly switched from one direction to another.

It is another object to provide an array of antenna apertures, stationary with respect to each other, fed through a lesser number of variable phase shifters for producing a spatially scanning radiation pattern.

It is another object to provide such an array producing a spatially scanning beacon that scans several beamwidths of the beacon for each phase shifter.

It is another object to provide an array of antenna apertures, stationary with respect to each other, fed through a lesser number of controlled variable phase shifters for producing a radiation pattern that scans a far greater angle than practicable by varying the phase shifters alone.

It is another object to provide an array of plurality of antenna apertures, stationary with respect to each other, fed through phase shifters from a common transmission line wherein the antenna apertures can be just about any kind of antenna element.

The above features and objects of the present invention and others will be apparent from the following specific description of embodiments of the invention which represent the best known uses of the invention, taken in conjunction with the drawings.

EMBODIMENTS OF THE INVENTION

Particular embodiments of the present invention which represent the best known uses of the invention are described herein. A fundamental feature of the invention is incorporated in a relatively simple structure that produces a highly directive net radiation pattern. The fundamental concept uses N antenna distribution networks that feed N overlapping sets of antenna apertures, (N sub-arrays). When this antenna system is used as a transmitting antenna the antenna apertures are referred to as radiating elements. In as much as the same principles apply whether defining the net radiation pattern of a transmitting antenna system or a receiving antenna system, the embodiments of the present invention described herein as well as the fundamental or generic feature and other features are all described in relationship to a transmitting antenna system.

The Spatial Scan Antenna System (LEA System) incorporates the fundamental feature, and additional features enabling electronically controlled fine spatial scanning of the radiation pattern beacon direction over many different scan sectors. These techniques are applicable to provide an antenna system of limited spatial scan or of wide angle spatial scan, useful in many radar and communications systems. Furthermore, changing from one scan sector to another is done by electronically controlled switches. As already mentioned, the techniques are applicable to receiving as well as transmitting antenna systems. Where the antenna system is transmitting, the radiation pattern is also referred to as the beam or beacon. More particularly, the beam refers to the central dominant lobe of the radiation pattern.

An example of a Spatial Scan System produces an electronically controlled spatially scanning beam and includes eight antenna distribution networks, eight SPMT switches and eight electronically controlled variable phase shifters. A parametric analysis of this particular example relating the number of elements, types of elements, element patterns and element combination techniques is included. That analysis indicates that this system is capable of forty beam widths of scan.

FUNDAMENTAL FEATURES

A linear array of a large number of radiating antenna elements (apertures) is energized as overlapping sets of arrays or sub-arrays and so some apertures in some sets are also in other sets. Each set is energized from a different distribution network that is, in turn, fed from a common source of high frequency energy that is scanned or switches. The sets of arrays are referred to herein (sometimes) as "large elements" and, hence, the system is a Large Element Array (LEA).

Figure 1A:
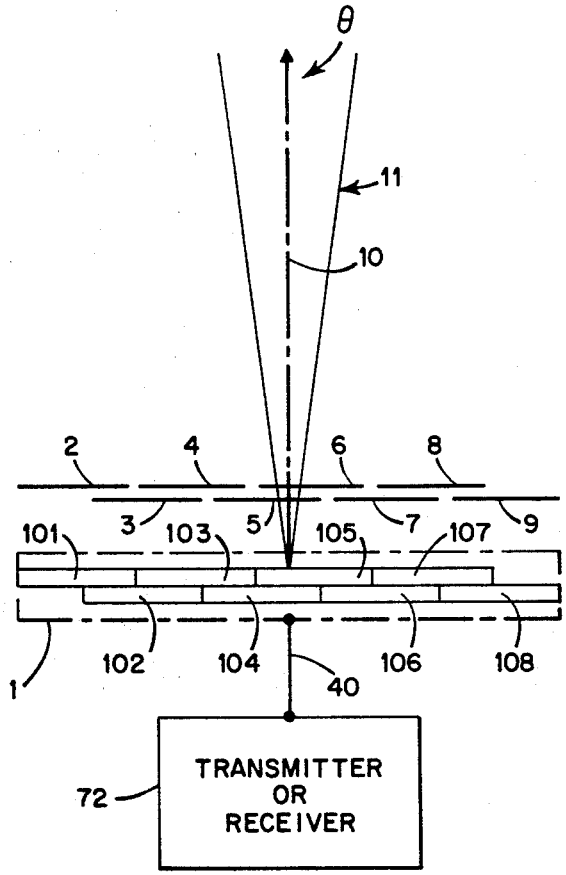
FIGS. 1*a* and 1*b* illustrate a common feature of the present invention.

Considering that each set launches a front of high frequency radiation, then the fronts must overlap, because the sets overlap. This is illustrated by FIG. 1*a* which shows the LEA 1 energized by a transmitter 72 via transmission line 40, so that the Large Elements 101 to 108 of the LEA launch overlapping wave fronts 2, 3, 4,5,6,7 8 and 9 that combine in space to produce a beam pointing in the zero scan direction along line 10. In the Spatial Scan System, a single beam is caused to fine scan the sector 11 by varying the phase shifters in the transmission lines that feed power to the large elements. Where there are N large elements, there are N variable phase shifters, although the number of radiating apertures far exceeds that number. In the Multiple Beam System, one of a plurality of beams spread across sector 11 is switched on at a time producing a fine granular scan of sector 11.

Varying the phase shifters according to a predetermined schedule can realize very precise control over the pointing direction of the beam within the sector 11. Beam direction within the center sector 11 is referred to as $\theta$.

Figure 1B:
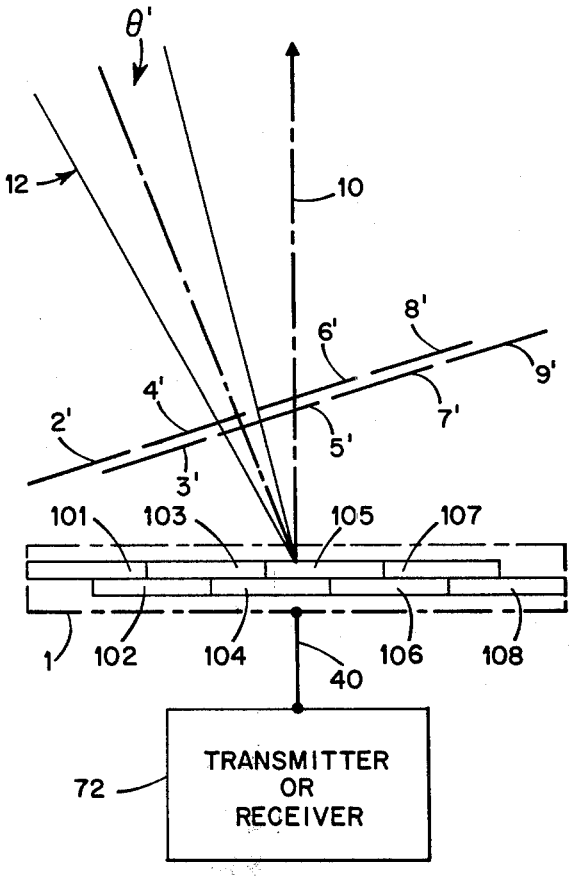

According to another feature of the present invention, the beam can be switched to another sector like sector 12 shown in FIG. 1*b*, by adding a linear phase shift across the elements. The effect of this is to produce wave front 2' to 9' in the direction of sector 12 as shown in FIG. 1*b*. The beam directions within sector 12 are referred to as $\theta'$.

Within each sector such as 11 and 12, fine scan is achieved by a single beam by varying phase shifters and by multiple beams by successively switching from beam to beam. Thus, either system is capable of fine spatial scan of the total sweep of the sectors.

LARGE ELEMENT ARRAY (LEA)

Figure 2:
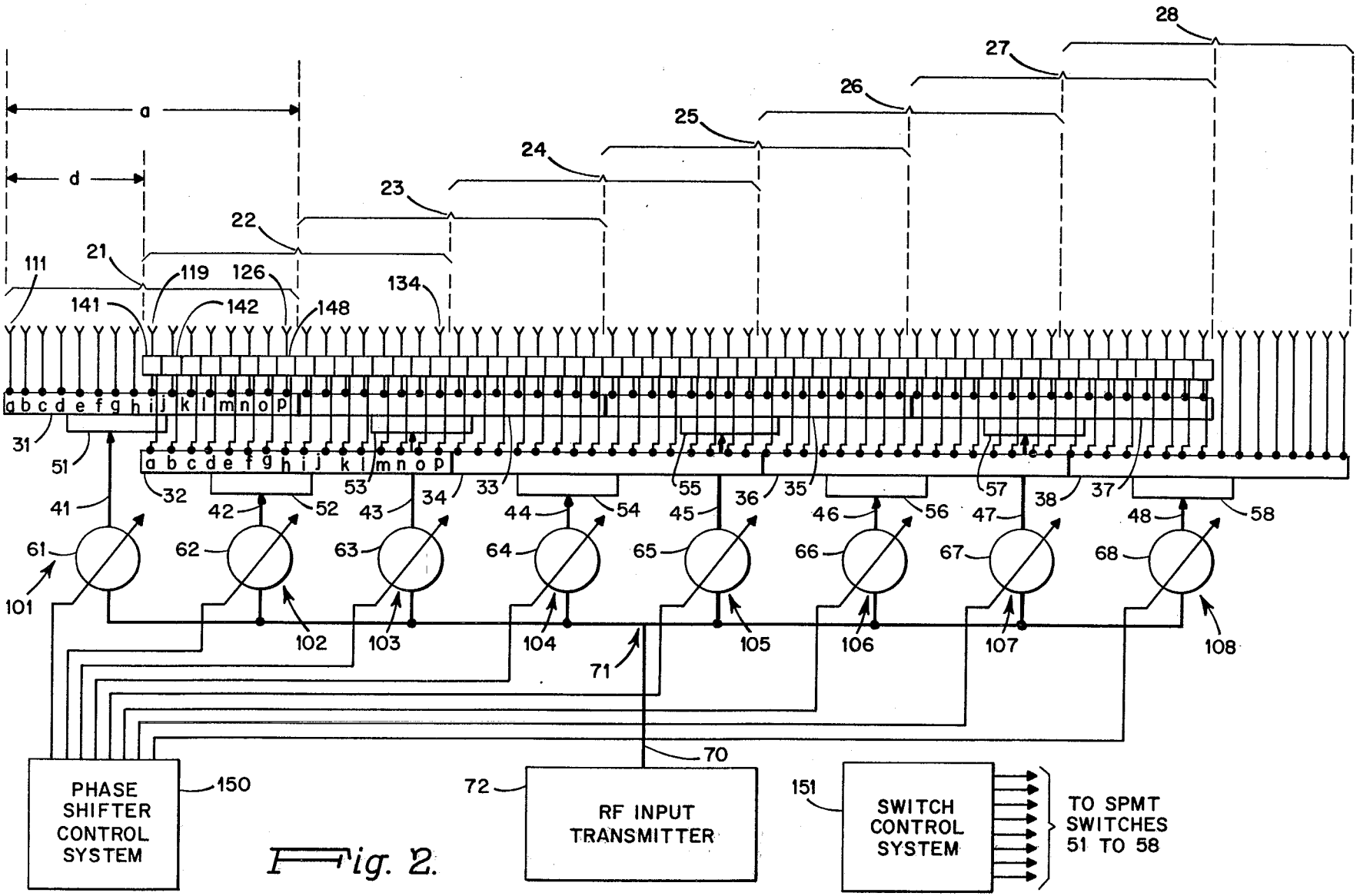
FIG. 2 is a schematic drawing illustrating a Spatial Scan Antenna System producing a spatially scanning beam, incorporating features of the present invention.

A Large Element Array (LEA) in a single beam Spatial Scan System is depicted in FIG. 2. Here, N antenna distribution networks for N sets of antennas are fed through N variable phase shifters and N single pole multi-throw switches (SPMT). Each antenna set, also called a "large element", overlaps the adjacent antenna set. More particularly, the eight antenna sets 21 to 28 are shown end to end overlapping and their distribution networks 31 to 38, respectively are shown in staggered relationship which is intended to illustrate that the distribution networks overlap each other with respect to their coupling to the antenna sets. Each network is fed by a corresponding transmission line 41 through 48, via an SPMT switch 51 to 58, and in each transmission line is a phase shifter 61 through 68, respectively. The network transmission lines all couple to a common transmission line 70 through a power divider 71, which may be an eight to one power divider or may distribute power as described below. RF energy is fed to the common transmission line 70 from a transmitter system 72.

The spacing from center to center of the antenna sets depicted in FIG. 2 is one half of the set aperture size. Hence, if the set aperture as depicted as the dimension "a" and the spacing is "d", then "d" is approximately one half "a". Each of the LEA's incorporates an antenna set that performs as a highly directional radiating array with, for example, a sin x/x array pattern, or it may have a flat top pattern giving uniform gain over a fairly wide angular sector. As an alternative, each of the large element radiation patterns can be pointed in slightly different directions and this results in some of the same characteristics exhibited by a flat top element LEA.

SINGLE BEAM SPATIAL SCAN ANTENNA SYSTEM

Figure 3:
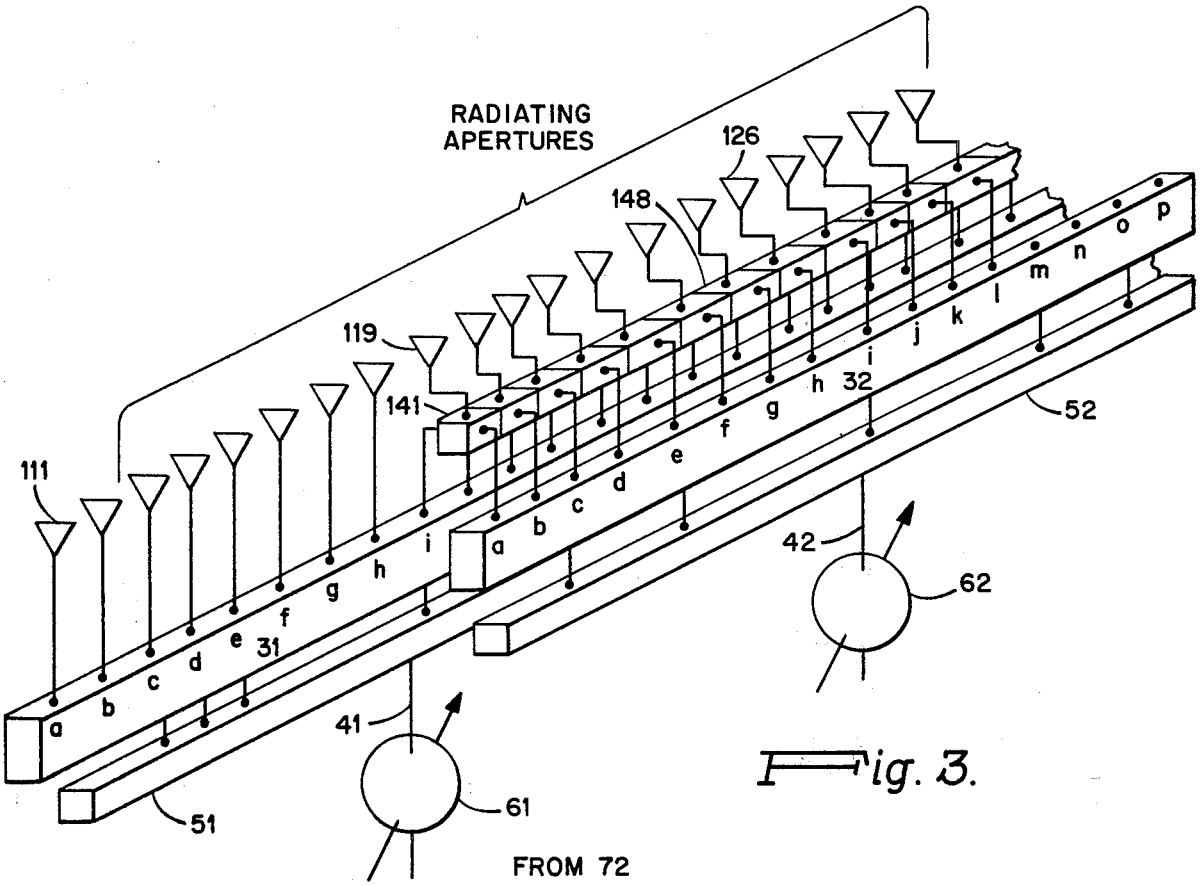
FIG. 3 is a perspective view of a portion of the Spatial Scan Antenna System.

A particular embodiment of the Spatial Scan Antenna System is represented structurally by FIGS. 2 and 3. Performance of this Example is illustrated by FIGS. 6, 7, 8*a* and 8*b*. In this embodiment, N=8, and each of the "large elements" includes a set of sixteen radiating antenna apertures driven from a distribution network that is fed by a SPMT switch from a transmission line including a variable phase shifter. Thus, the first "large element" in these figures, denoted 101, includes the set of apertures 21, distribution network 31, SPMT switch 51, network transmission line 41 and variable phase shifter 61. The other "large elements" are denoted 102 to 108; and, clearly, the sets of apertures 21 to 28 of large elements 101 to 108, respectively, overlaps. For example, apertures 111 to 126 of set 21 overlap apertures 119 to 134 of set 22 and so forth for the rest of the seventy two apertures in sets 21 to 28.

The individual apertures that overlap include all, but the first eight (111 to 118) and the last eight of set 28. The rest of the radiating apertures are all shared by two adjacent sets of apertures and are driven from two adjacent networks via hybrid combiner circuits. For example, aperture 119 is driven from networks 31 and 32 via hybrid combiner 141. Similarly, apertures 120 to 126 are driven from adjacent networks via hybrid combiners 142 to 148, respectively, as shown by FIG. 2.

The distribution networks 31 to 38 may be identical structures, both mechanically and electrically, and they may be arranged, as shown by FIGS. 2 and 3, mechanically overlapping each other. The networks are fed from their corresponding transmission lines that contain corresponding variable phase shifters via corresponding SPMT switches. For example, network 31 that feeds elements 111 to 126 is fed by SPMT switch 51 from transmission line 41 that contains variable phase shifter 61. The elements 111 to 126 are fed from sixteen different phase points along the network 31, denoted a to p and the phases at those points at any given instant will depend on the phase shift caused by the variable phase shifter 61 and on the position of the SPMT switch 51.

The SPMT switches 51 to 58 may be identical. For example, they may each have M positions and at each position a switch feeds its corresponding network at a different input. In this example, M=5 and so as a switch like switch 51 is switched from one of its M positions to another it changes by a predetermined amount of phase shift the phases at the outputs a to p of network 31 and the shift imposed by variable phase shifter 61 is added to this.

Assume for this example that the networks, SPMT switches, variable phase shifters and radiating elements are all identical and that power divider 71 divides power from transmission line 70 to the networks symmetrically; and assume further that the electrical length of all lines shown in FIGS. 2 and 3 are negligible as compared to phase differences between outputs a to p of network 31, shifts produced by switch 51 and variable phase shifter 61. Then, it is convenient to locate the networks mechanically overlapping as shown in these figures. Furthermore, it is convenient that adjacent overlapping points of two networks feed the same radiating element. For example, in FIG. 2, adjacent outputs 31*i* and 32*a* in networks 31 and 32, respectively feed element 119 through hybrid combiner 141.

Assuming further that the antenna feed points along a network, like outputs 31*a* to 31*p* of the network 31 are evenly spaced and this is the same for all the networks, then, if 31*i* and 32*a* are adjacent, the mechanical overlap of the networks is 2:1.

Thus, all radiating elements but the first eight and last eight are energized from adjacent overlapping outputs of two different distribution networks. As will be seen, the phase of the RF power at the two outputs is often different and so the phase of the radiating element fed from the two points is determined by the vector sum of the voltages. I have discovered that this type of coupling does not result in excessive loss. The system loss is less than one db.

Fine spatial scanning of the beam can be accomplished with the antenna system shown in FIGS. 2 and 3 by varying the phase shifters 61 to 68 in accordance with a prescribed schedule. There are many well known techniques of construction of electronically variable phase shifters that could by employed here to produce a precise fine scan over a small sector a few beam widths wide using relatively few phase shifters.

Coarse beam scanning is accomplished using the throws of SPMT switches 51 to 58, one for each network, feeding the network at M different points along the network. The SPMT switch is used effectively in conjunction with the electronically controlled phase shifters to cause the beam to scan precisely over this much wider total angular scan. With switches such as these the sector coverage can be increased by a multiplier approximately equal to the number of throws, M, of a switch. It can be shown that the theoretical limit in total sector coverage is approximately $(N+1)\times M$ beam widths. Here, as already mentioned, N is the number of networks, the number of switches and the number of phase shifters and M is the number of throws of each switch. In a conventional phased array, the maximum total sector coverage is N beam widths, where, again N is the number of phase shifters. For this example of the present invention N=8 and M=5 and so the theoretical limit in total sector coverage is $(N+1)\times M=45$ beam widths.

A set of parameters for a single beam, large element array (LEA), electronically controlled spatially scanning antenna system are discussed below with respect to the system of FIGS. 2 and 3. In this example, the phase shifters 61 to 68 are electronically controlled and so are the switches 51 to 58. The phase shifter electronic control system 150 is represented only as a system and no details of construction of that system are described herein. Similarly the electronic SPMT switch control system 151 is shown only as a system, no details thereof being revealed herein. It is well known by those skilled in the art to select, design, or obtain suitable phase shifter and switch electronic control systems to accomplish the uses of this embodiment described herein, as well as other uses not described herein.

The parameters of this embodiment are as follows:

| | |
|---|---|
| 1. N, number of antenna assemblies | 8 |
| 2. antenna distribution network overlap factor | 2:1 |
| 3. electrical length of distribution network | 13.3 wave lengths |
| 4. antenna assembly beam width | 5.1 |
| 5. power divider amplitude distribution large elements 101 to 108, respectively | .45-.6-.8-1.0-1.0-.8-.6-.45 |
| 6. system beam width | 1° |

The fine scan sector of the above described antenna system without introducing any step in the scan by the switches 51 to 58 is related to the grating lobe spacing and beam null width as follows:

$$\theta_{scan}=2(\theta_g-\theta_n) \quad (1)$$

where:

$$\theta_g=\sin^{-1}(\lambda/d);\ \text{(grating lobe spacing)} \quad (2)$$

$$\theta_n=\sin^{-1}(k\lambda/a);\ \text{(one-half null width)} \quad (3)$$

and "k" is related to the directivity of a large element (antenna set) radiation pattern. For example, k=1.5 for a set with a cosine aperture distribution, k=1.25 for a cosine on a 10 db pedestal and k=1.0 for a uniformly illuminated aperture. For a 2:1 overlap of adjacent sets and distribution networks, the relationship between the number of antenna sets N and the fine scan sector is as follows where A is the total LEA array size:

$$a=2A/(N+1) \quad (4)$$

$$d=a/2 \quad (5)$$

$$\theta_{scan}=2(\sin^{-1}\lambda(N+1)/A-\sin^{-1}k\lambda(N+1)/2A)\approx(2-k)(N+1)\lambda/A \quad (6)$$

For the example selected and represented by the parameters listed above, k=1.5 and $\theta_{scan}=(N+1)\lambda/2A$. If the array beam width is approximately $\lambda/A$, then the fine scan angle achievable without beam stepping by the switches is about $(N+1)/2$ beam widths, or 4.5 beam widths. If a uniform illumination were chosen, the theoretical scan limit before the grating lobe overlaps the element beam array and is $(N+1)$ total array beam widths.

Radiation patterns of the Example Antenna System described above, without beam stepping, are shown in FIGS. 8*a* and 8*b*. The beam width of this system is approximately 1.1°. The large element (antenna sets) radiation patterns are set at different pointing angles; half of them are set at 0° and the other half are set at 2.2°. This is done to minimize array gain variation versus scan angle. Each large element can be stepped scanned in increments of 4.4° which is referred to as $\theta_{scan}$, and is four beam widths. Fine scan is achieved by setting the phase shifters at a precise value as given below:

$$\phi_n = (2\pi nd/\lambda) \text{ Sin } \theta_o; \tag{7}$$

where n=1 to N and $\theta_o$= pointing angle. The patterns shown in FIGS. 8*a* and 8*b* demonstrate uniformity and gain within a tolerance of + or − ¼ db over a fine scan sector. They also show low side lobe and grating lobe levels and extremely low radiation levels at angles beyond the element pattern sector. The sharp drop off in radiation energy is particularly important when trying to minimize radiation into undesirable sectors such as negative elevation angles when the system is used to scan elevation.

Phase requirements of the Example Antenna System over a fine scan sector are similar to the phase requirements of a conventional phased array of the same size, scanning the same sector except, the number of phase shifters required is far less. The accuracy of the phase shifters and the bit size are also comparable. One distinct advantage of the present invention is that the present system requires relatively few phase shifters and so the complexity of the equipment for monitoring the phase shifters is less. Typical conventional phased array monitoring systems only indirectly monitor the phase shifters through measurement of the control current or voltage. Although this can be implemented as well for the present invention, more sophisticated and accurate monitoring networks are now practical from the aspect of cost. Conventional monitoring equipment of high accuracy compare each phase shifter with a reference and correct any phase shifter with a closed circuit loop control arrangement. The level of sophistication of phase shifter control and monitoring and correction specified for the Example System can be very high because of the few phase shifters involved. Hence, reliability is high even while the antenna system is dependant on many fewer variable components than in a conventional equivalent phased array antenna system.

Figure 6:
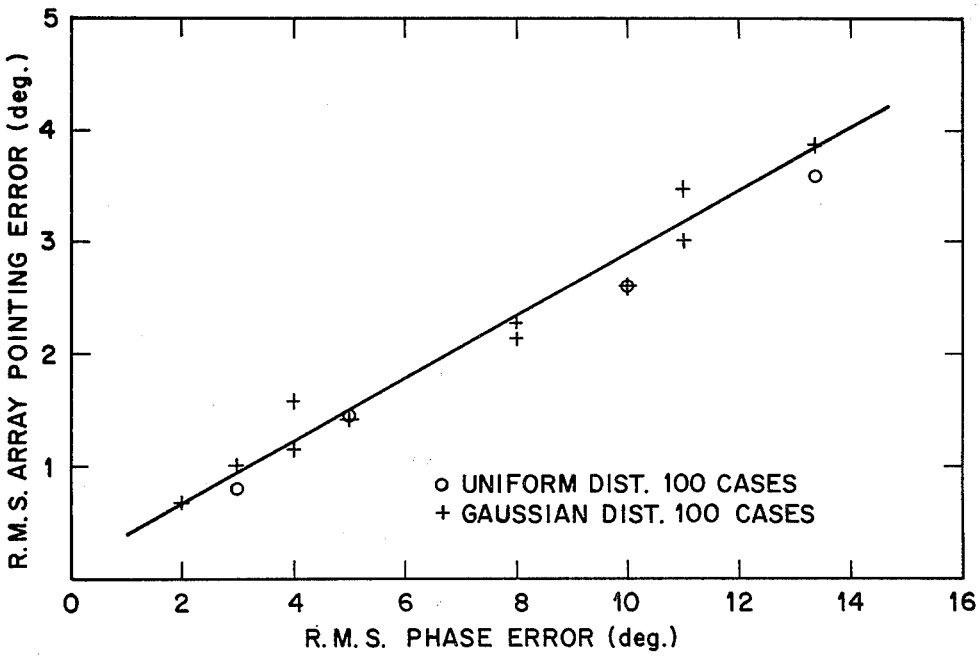
FIG. 6 is a plot of the Spatial Scan Antenna System pointing error versus phase error over a scanned sector.

Another advantage of the present invention is that if a phase shifter is lost, this does not result in incorrect beam positioning. The effect on the system is primarily to the aperture amplitude distribution, and so the result is that the side lobe level and beam width and gain change, but not the beam position. A phase error analysis of the Example Antenna System having eight antenna sets defined by the parameters listed above, for a large number of cases of random phase error across the system aperture is illustrated by FIG. 6 which is a plot of beam pointing error versus the random phase error. As can be seen from FIG. 6, the effect of a phase error on the other characteristics of the Example System is small and is given below for an eleven degree rms phase error.

| Performance Parameter | Mean Error | rms Error |
|---|---|---|
| Pointing Angle | <.002° | .03° |
| Beamwidth | <.003° | <.004° |
| Beam Level Variation | <.04 db | <.05 db |

Figure 7:
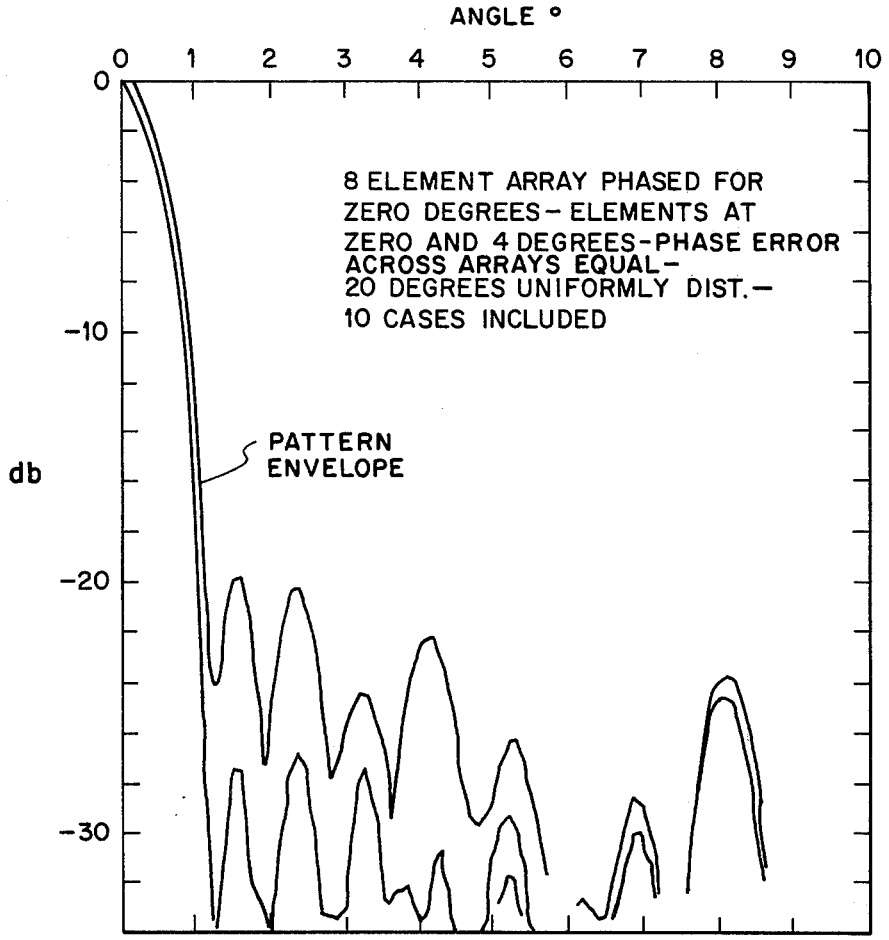
FIG. 7 illustrates the radiation pattern for the Spatial Scan Antenna System for the cases plotted in FIG. 6.
Figure 8A:
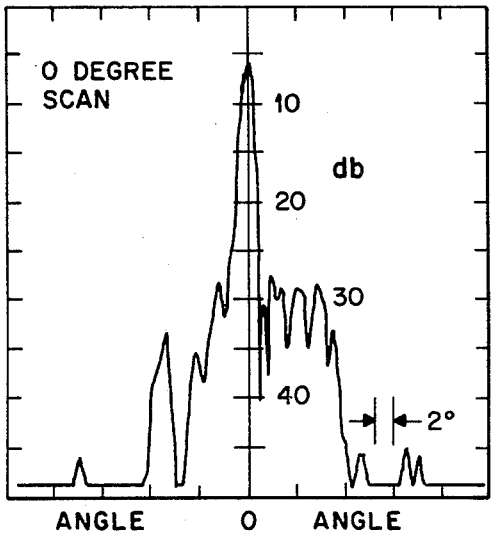
FIGS. 8*a* and 8*b* show the net radiation pattern for Spatial Scan Antenna System at zero degree and 1.2 degree sector scan.
Figure 8B:
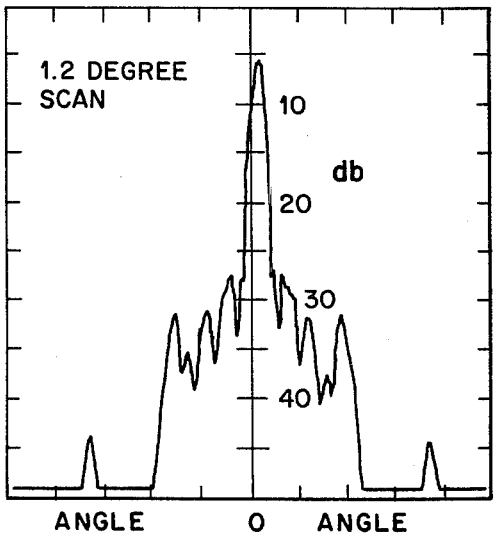

FIG. 7 illustrates the radiation patterns obtained for ten cases of phase error, assuming a ±10° maximum error uniformly distributed across the antenna system aperture. The side lobe degradation shown by these patterns is presumed to be similar for other aperture distributions, although the absolute level may differ.

A large element gain variation, such as gain variation of the large element due to switch or path loss insertion loss differences, results in a minor effect upon the Example System performance. For example, a one db gain variation in a large element, such as any of the large elements 101 to 108 will result in a gain variation of the System pattern of 0.07 db to 0.16 db, depending upon which large element is affected. For a large element, gain is proportional to the sum of the voltages of the individual radiating elements of the corresponding set. Side lobe levels and beam width are affected to a minor extent due to the large element gain variations. However, the System pointing direction is not affected.

The System absolute gain is a function of the individual large element gains and the System aperture directivity. The loss due to the combining of the overlapping distribution networks of the large elements is of some concern. This loss can be represented as follows:

$$\alpha = \frac{G_n \left[ \sum^{N} \sqrt{P_n} \right]^2}{2G_A} \tag{8}$$

Where $\alpha$ is the ratio of the LEA system gain versus the gain of a classical antenna of aperture A with gain $G_A$, $P_n$ is the input power to one of the large elements, n, normalized to the total LEA power available, and $G_n$ is the gain of the large element n. If the aperture efficiency is the same for all of the large elements 101 to 108, and the full LEA system array, then the ratio of $G_n$ to $G_A$ would be equal to the ratio of their aperture sizes (a/A as defined in equation (4)) and the loss factor becomes:

$$\alpha = \frac{\left[ \sum^{N} \sqrt{P_n} \right]^2}{N+1} \tag{9}$$

For a uniformly distributed array of large elements, like 101 to 108, the loss factor is minimal and would be N/(N+1) or 0.89 (0.5 db) for the case, as in the Example, of eight antenna assemblies, N=eight. For the distribution used in this Example, the value is 0.82 (0.86 db).

The Example System described herein provides a $\theta_{scan}$ of approximately 4 beamwidths. In accordance with the present invention, far greater scan coverage is obtained with a particular set of design parameters by making each of the large elements scannable. This is done using the SPMT switches 51 to 58. The switches may be identical and each has M beam ports and so the switches are referred to as single pole M throw switches. For example, a scan of 20 beamwidths can be achieved using scannable large elements that all scan five sectors, each four beam widths wide. The total number of active components in such a system is eight phase shifters and eight SP5T switches. Thus, in this system N=8 and M=5. Using a more efficient large element could result in an increase in the coverage by a factor of 2 or up to 40 beamwidths of total scan.

TWO DIMENTIONAL SCAN LEA

The fundamental concept of overlapping large elements producing coarse switching of the beam from sector to sector and fine scan of each sector can be applied to provide a two dimentional LEA that produces a beam that scans in two directions. More particularly, the techniques and structures already described can be used to provide a row-column arrangement of large elements. This is illustrated by FIG. 4.

Figure 4A:
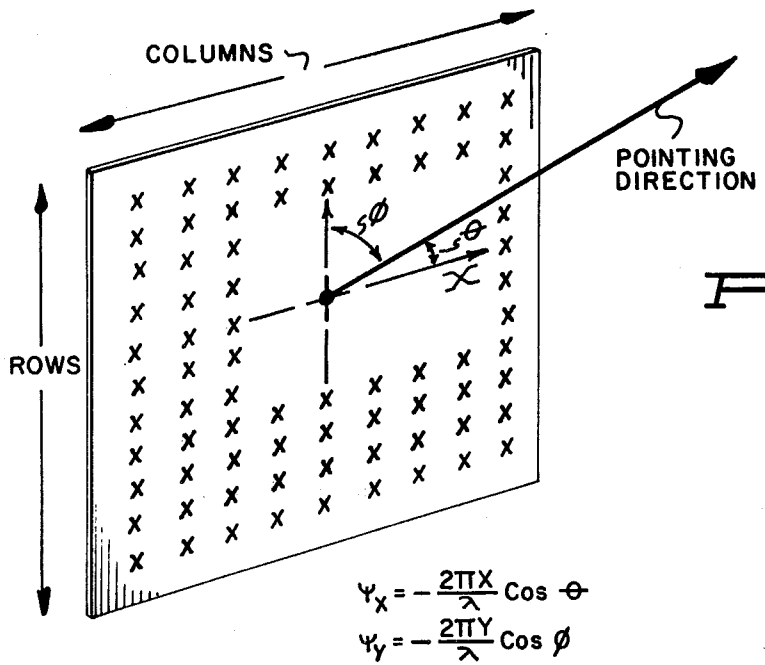
FIG. 4*a* is a diagram showing the parameters of an antenna system according to the invention that spatially scans in two dimensions.

Assuming a planar array of elements arranged in rows and columns as shown in FIG. 4*a*, the phase requirement across the aperture to scan a beam in the direction $\theta$, $\phi$ is the sum of $\Psi x$ and $\Psi y$ shown in FIG. 4*a*. The linear distributions $\Psi x$ and $\Psi y$ are the same as that generated from the one dimensional LEA. Therefore, if we use one LEA for each column of elements and take the output of the antenna networks as feeds for elements of each row rather than radiators, and when these elements correspond to the large element of each row, we effectively provide this summation of linear phase distributions. Phase shifters in the column LEA's provide the necessary control for fine scanning of the beam in azimuth and elevation. The multiple input networks in the column and row LEA's determine the course sector coverage. A more detailed two dimensional physical description of this scanning antenna system is shown by FIG. 4*b* and described below.

Figure 4B:
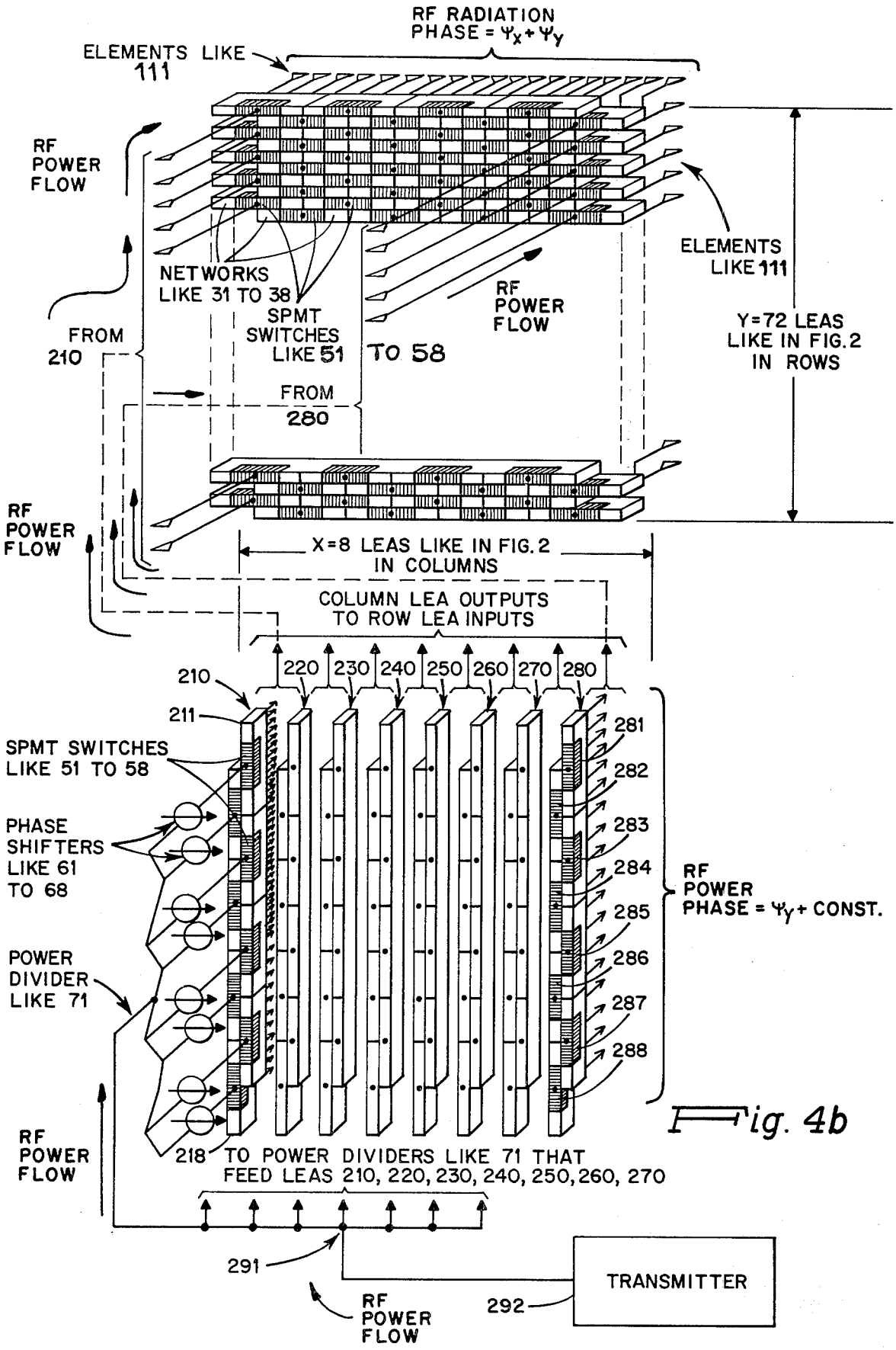
FIG. 4*b* is a schematic drawing illustrating such an antenna system for producing a radiation pattern that spatially scans in two dimensions, incorporating the Spatial Scan Antenna System.

The two dimensional scan LEA, as shown in FIG. 4*b*, includes Y LEA's in parallel rows (shown horizontal) each constructed substantially as already described with references to FIGS. 2 and 3 except that the networks of the large elements of these LEA's are not fed by the network's corresponding transmission line via a variable phase shifter and power divider. Instead, the networks in the rows are fed by the outputs of the hybrid circuits of X LEA's in parallel columns (shown vertical) and the networks of the columns are fed by corresponding transmission lines via variable phase shifters and SPMT switches, all from power dividers and a transmitter. FIG. 4*b* shows X=8, LEAs 210,220,230,240,250,260,270 and 280 in parallel columns (shown vertical) each including eight large elements. In LEA 210, the large elements are 211 to 218; in LEA 220 the large elements are 221 to 228; and so forth. The input to each of these large elements includes an SPMT switch and a variable phase shifter and the phase shifters of each column LEA are fed from a power divider, just as already described with respect to FIGS. 2 and 3. Those power dividers are, in turn, fed from a common power divider 291 that is fed from the transmitter 292.

The outputs of the column LEAs are from the same lines that feed the individual radiating elements of an LEA; it includes the outputs of all the hybrid combiners and the direct outputs from the first and last network of each LEA. These outputs feed the SPMT switches at the inputs of the elements of the row LEAs and so the first column LEA 210 feeds the first large element of all of the row LEAs. More particularly LEA 210 feeds the SPMT switch of the first large element of all of the row LEAs.

Assume for this embodiment that there are eight large elements in each LEA, and so N=8. Also, assume there are eight column LEAs and so X=8 and that each LEA has seventy two outputs that correspond to the individual radiating elements like element 111 shown in FIG. 2. Thus, there are seventy two row LEAs and so Y=72. This results in a seventy two by seventy two, two dimensional array of individual radiating elements like element 111, or a total of $72\times72=5184$ radiating elements for which there are $8\times8=64$ variable phase shifters and $(8\times8)+(72\times8)=640$ SPMT switches.

This may be compared with a conventional two dimensional seventy two by seventy two array of individual radiating elements that would require 5184 variable phase shifters. Clearly, control of 64 variable phase shifters and 640 multi-throw switches involves less complicated controls than control of 5184 variable phase shifters. Control of 640 five position switches, like SPMT switches, that all switch simultaneously to prescheduled positions involves a relatively simple control; whereas control of the phase shifters requires individual control according to a schedule of each phase shifter.

No schedules for control of the phase shifter or the SPMT switches are described herein. It is within the state of the art for those skilled in the art to devise such schedules and the electronic controls for carrying out the schedules and so produce a beacon that scans space as desired.

DISTRIBUTION NETWORKS

The distribution networks, such as networks 31 to 38 shown in FIG. 2, are each fed by a SPMT switch. Each of the SPMT switch outputs connects to a predetermined point or input in the network and so depending upon the position of the switch, the network is fed at one input or another. Other point, (output points) in the network, like outputs 31*a* to 31*p* of network 31 feed the individual radiating antenna elements, like elements 111 to 126 respectively, and those network output points are usually at a different phase. Scanning the variable phase shifters causes those outputs to scan phase in such a way that the beam scans spatially. Thus, a fine, non-granular spatial scan of the beam is achieved. Then, by changing the SPMT switch positions there results a predetermined phase change at each of the network output point, calculated to switch the beam to another spatial sector. The phase shifter and SPMT switch control is all according to a predetermined schedule devised to produce the desired spatially scanning beam that fine scans sectors by varying the variable phase shifters and switches from sector to sector in whatever sequence is desired.

The antenna distribution networks may be, for example, a simple slotted waveguide array of a printed circuit or microwave lens or a Butler Matris with several inputs and outputs. In general, a network may be any sort of RF delay system having output points of fixed RF phase differential with respect to each other, and different input points that shift the phases of the output points when the network input is shifted from one input to another.

A network may be constructed of phase shift devices like 3 db couplers, as in a Butler Matrix. FIG. 5*a* shows a sixteen port Butler Matrix network that is suitable for use in all embodiments of the present invention. It has sixteen output ports and sixteen available input ports of which any number may be fed by an SPMT switch. It is comprised of 3 db directional couplers, all couplers in the network being identical. In this Matrix, an RF input to any one of the input ports produces outputs of equal amplitude at all the output ports, but the schedule of phases at the output ports differs depending on which input port is fed.

The sixteen port Butler Matrix, shown by FIG. 5*a* is, for example, network 31, fed by SPMT switch 51. The sixteen output ports are denoted 31*a* to 31*p* and the five input ports fed by the switch are 31*t* and 31*v*. Between the input and output ports are thirty two equal 3 db directional couplers, denoted generally 31*x* and connected as shown. Construction and operation of a Butler Matrix such as shown here is described in:

MICROWAVE SCANNING ANTENNAS Volume III by Hansen, Published by Academic Press of New York, N.Y.

Figure 5B:
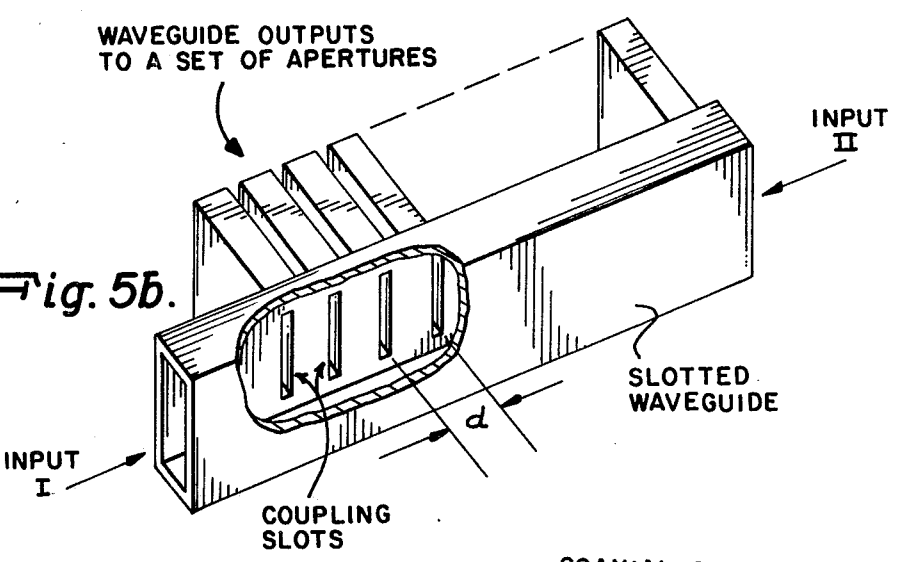
FIG. 5*b* illustrates use of a slotted waveguide array as the network in the LEA Antenna Systems described herein.

In the case of the slotted waveguide array as depicted in FIG. 5*b*, energy fed in port I is coupled out of the slots with an amplitude that is determined by the slot dimensions and at a phase that is determined by the slot spacing d. Each slot output is directly coupled to one of the hybrid combiners 141 to 148. A scanned phase front can be generated from the waveguide array by reversing the input to the array from port I to port II as shown.

Figure 5C:
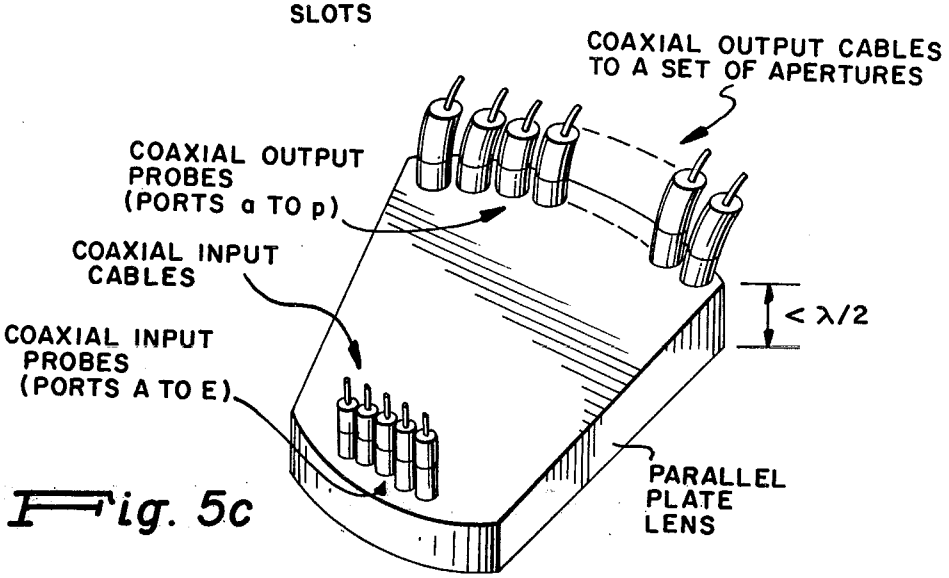
FIG. 5*c* illustrates use of a microwave lens as the network.
Figure 5A:
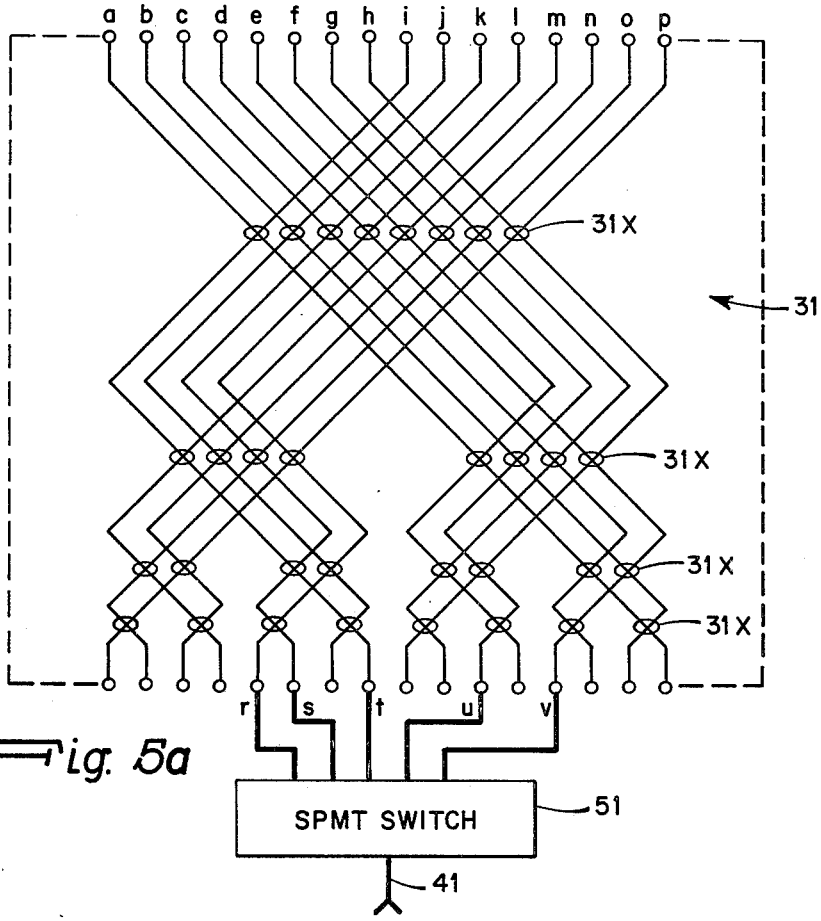
FIG. 5*a* is a schematic drawing illustrating a sixteen port Butler Matrix beam forming network that can be used as the network in the LEA Antenna Systems described herein.

A microwave lens is depicted in FIG. 5*c*. It has five separate input ports, A to E, and sixteen output ports a to p. Energy fed into one of the input ports travels through the parallel plate lens in the TEM mode and is coupled out of the ports a to p. The phase distribution of the output energy changes when the input port is changed.

MULTIPLE BEAM SWITCHED ANTENNA SYSTEM

The overlap feature of the present invention can be applied to provide a multiple beam antenna system or a multiple beam array consisting of an array apertures in overlapping sets together with overlapping aperture distribution networks that are fed by an arrangement of other phase distributing networks and switches from a common transmission line. The feed to the overlapping networks is such that any one of a plurality of beams is produced depending upon the position of a switch and also depending upon a switch position, the beam produced is in any one of several spatial sectors like sectors 11 and 12 shown in FIGS. 1*a* and 1*b*. Hence, through switching action alone, the pointing direction of the beam is selected. These systems do not use variable phase shifters, the only variables are switches.

Figure 9:
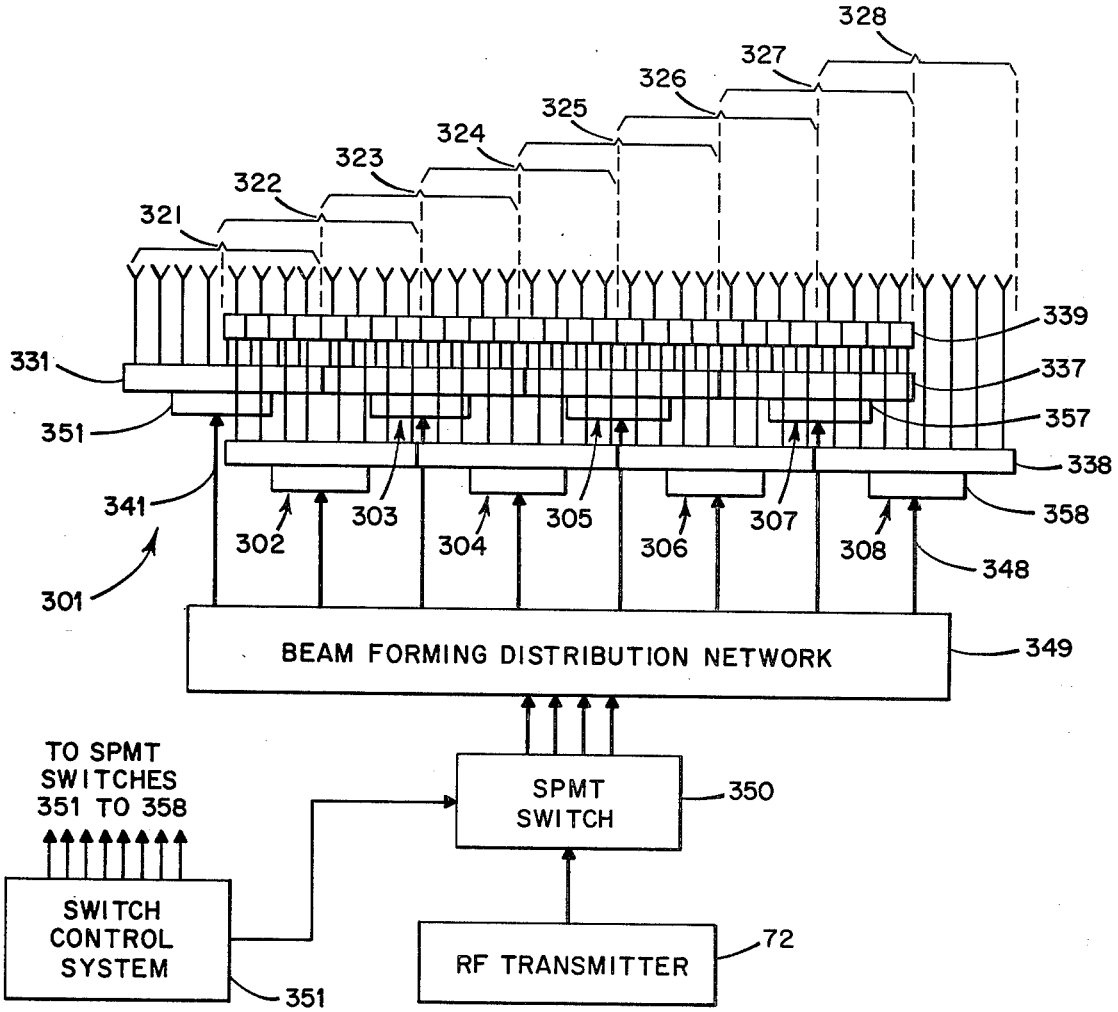
FIG. 9 illustrates a Multiple Beam Antenna System incorporating the large elements of the present invention, but without variable phase shifters capable of selecting one or another of the beams thereby controlling the pointing direction of the net radiation pattern.
Figure 10:
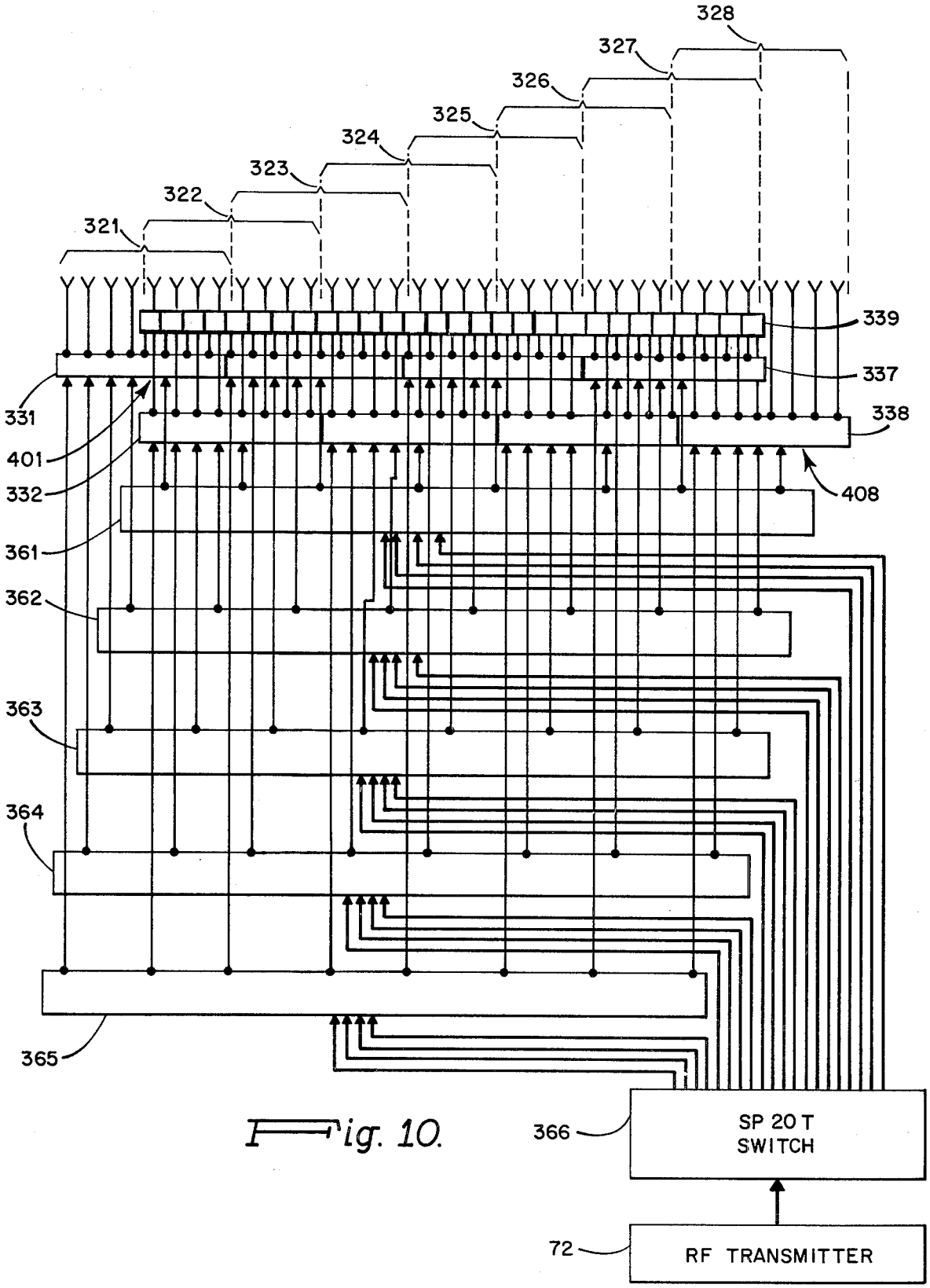
FIG. 10 illustrates another Multiple Beam Antenna System incorporating the large elements of the present invention, but without SPMT switches and variable phase shifters, also capable of switching on one or another of the beams, thereby controlling the pointing direction.

A Multi Beam Switched Antenna Systems are shown in FIGS. 9 and 10. These systems are capable of selecting one of several (for example four) beams the system can produce across a spatial sector like sectors 11 and 12. These systems are also capable of switching from sector to sector just as the Single Beam Spatial Scan System already described. Hence, the system is capable of fine and coarse switching and when the switching schedules call for switching from beam to beam in steps across a sector and then in stepping in the same way across the next adjacent sector, the result is a spatial scan that is granular for both the fine and coarse control.

The multi beam system shown in FIG. 9 is an LEA of eight large elements 301 to 308 made up of eight overlapping sets of apertures 321 to 328 fed by eight distribution networks 331 to 338 through hybrid combiners 339. The networks are fed by eight SPMT switches 351 to 358 from transmission lines 341 to 348 and these transmission lines are fed each by a different output of beam forming distribution network 349 that may be an eight port Butler Matrix. The input ports of this network 349 are fed by transmitter SP4t switch 350 that selectively feeds RF from the transmitter 72 to the system. Here, N=8, and let M=5 and the number of beams B=4.

Clearly, no variable phase shifters are used. Fine switching from beam to beam within a sector is by switch 350 and coarse switching from sector to sector is by the network SPMT switches 351 to 358. In operation, at any given instant the net radiation pattern from the overlapping sets of apertures is one of the four multiple beams selected by switch 350. Network switch control system 351 is programmed to place the selected beam in the selected sector.

In this embodiment, the large elements of the array may be the same as elements 101 to 108 shown in FIG. 2, each feeding sixteen apertures in which case the element networks could be sixteen port Butler Matrices as shown by FIG. 5, or they could be eight port Butler Matrices each feeding eight antenna apertures as shown by FIG. 9. The choice depends upon the beam pointing precision desired.

Another multiple beam antenna system is illustrated by FIG. 10. Here, the overlapping sets of apertures 321 to 328 are fed by networks 331 to 338 via hybrids 339 forming large elements 401 to 408 similar to FIG. 9. However, the network inputs of these large elements are not fed by switches. There are no SPMT switches at the inputs to these networks. Instead, each of the large element networks are fed by the LEA beam forming distribution networks 361 to 365. More particularly, the five inputs of each network 331 to 338 are each from a different one of the LEA networks 361 to 365, and there are four inputs to each of the LEA networks. The LEA network inputs are all fed from transmitter SP20T switch 366 and that switch is fed by the transmitter. All control in this system is by switch 366 which places the beam in any of twenty different spatial positions. More particularly, the LEA network energized determines the spatial sector and the particular input to that network determines which of the multiple beams in that sector is turned on. In this example there are four beams and five sectors and so the total number of beam directions is twenty and the direction is selected by switch 366.

In both multiple beam embodiments there is coarse control or selection of the beam pointing direction (sector selection) and there is fine selection (beam selection) and both controls are granular.

CONCLUSIONS

The overlapping large element array, LEA, is a common feature of all the systems described herein. The overlapping technique is incorporated for advantage in a single beam spatially scanning antenna system represented by the spatial scan Antenna System, illustrated by FIG. 2 and it is incorporated in Multiple Beam Antenna Systems represented by FIGS. 9 and 10. Some of the advantages of these systems as compared with conventional systems are mentioned. Other advantages will be apparent of those skilled in the art.

The spatially scanning single beam antenna system described herein has performance characteristics comparable with some conventional phased array antenna systems and so can be used in the same ways. For example, it can be used for one and two dimensional scan, for beam scanning radar and communications system, for sum and difference mode operation, for multiple beam systems and for adaptive arrays. The basic difference between the present invention and conventional phased array spatial scanning and/or multibeam systems is in the novel overlap of sets of antenna apertures fed from the distribution networks permitting fewer variable components or controlled components to be used than in the conventional systems.

The novel overlap antenna array concept that is disclosed herein and the specific examples described incorporating the concept can have numerous variations of the parameters described and other implementation techniques can be used. For example, the amount of overlap of the sets of apertures, the number of large elements, the number of phase shifters and/or SPMT switches, the number of switch throws and the number of beam forming networks can be other than described, all without deviating from the spirit and scope of the invention as set forth in the appended claims.

What is claimed is:

1. In radio frequency (RF) antenna system having a linear array of $\eta$ antenna apertures for which the net radiation pattern has a pointing direction and means for coupling said antenna apertures to a common transmission line that conducts high frequency energy to or from the apertures, the improvement comprising, (a) N aperture distribution networks each having a plurality of outputs of which successive outputs are coupled to the antenna apertures in serial order and at least one input a plurality of inputs coupled to the common transmission line, (b) the $\eta$ apertures being designated as included in N different sets of apertures where $N<\eta$ (c) the outputs of each network being electrically coupled to a different one of said sets of said apertures, some of said network outputs having an aperture in common, (d) a separate network transmission line for each network, coupled to the network input (e) variable phase shifting means in each network transmission line, (f) means for coupling said network transmission lines to said common transmission line and (g) means for varying said variable phase shifting means thereby varying said pointing direction.

2. An antenna system as in claim 1 wherein, (a) said means coupling the network and common transmission lines is a power divider if the array transmits and is a power combiner if the array receives.

3. An antenna system as in claim 2 wherein, (a) the power is not evenly divided or combined between the common and network transmission lines.

4. An antenna system as in claim 3 wherein, (a) the networks are all electrically the same.

5. An antenna system as in claim 1 wherein, (a) at least some of said networks have a plurality of inputs and means are provided for selectively coupling said inputs to the corresponding network transmission line, whereby said selection of coupling enables step changes in said pointing direction while said variable phase shifting means enables gradual changes in said pointing direction between said step changes.

6. An antenna system as in claim 5 wherein, said selective coupling of the inputs of a network to the network transmission line, couples one network input at a time to the network transmission line.

7. An antenna system as in claim 6 wherein, (a) means are provided for controlling said last mentioned means, thereby controlling said pointing direction in relatively coarse steps.

8. An antenna system as in claim 5 wherein, (a) the plurality of inputs of a network are electrically coupled to the common transmission line via a multithrow switch.

9. An antenna system as in claim 8 wherein, (a) means are provided for controlling said switch to control said pointing direction.

10. An antenna system as in claim 7 wherein, (a) the pointing direction is controlled by the combination of controlling the means for selective coupling the inputs of a network to the common transmission line and, (b) by varying the variable phase shifting means.

11. An antenna system as in claim 10 wherein, (a) coarse control of the pointing direction is by control of said selectable network inputs and, (b) fine control of the pointing direction is by varying said variable phase shifting means.

* * * * *